US005134740A

United States Patent [19]

Summer

[11] Patent Number: 5,134,740

[45] Date of Patent: Aug. 4, 1992

[54] MEDITATION SUPPORT

[76] Inventor: Brian C. S. Summer, 59 Grinnell St., Greenfield, Mass. 01301

[21] Appl. No.: 796,082

[22] Filed: Nov. 20, 1991

[51] Int. Cl.[5] ..... A47C 16/00; A47C 27/00; A47C 27/08

[52] U.S. Cl. ..... 5/652; 5/653; 5/648; 297/459

[58] Field of Search ..... 5/431, 434, 436, 443, 5/441, 442, 420; 297/458, 459

[56] References Cited

U.S. PATENT DOCUMENTS 2,314,080 3/1943 Dink et al. ..... 5/431
3,890,004 6/1975 Rail ..... 5/443
4,673,216 6/1987 Alfer ..... 5/431
5,029,350 7/1991 Edelson ..... 5/431

FOREIGN PATENT DOCUMENTS 6362 of 1894 United Kingdom ..... 5/431

*Primary Examiner*—Alexander Grosz

[57] ABSTRACT

Meditation in the seated position with both knees flat on the floor is enhanced by a tapered seat that is provided with at least one recess to accomodate a heel. The taper of the support is downwardly toward the heel recess, thereby encouraging the meditator to sit erect with much of the weight felt on the knees. Sloping downward projections from the seat that extend under the thighs serve to distribute the weight and reduce any problem of circulation in the legs.

5 Claims, 2 Drawing Sheets

MEDITATION SUPPORT

FIELD OF THE INVENTION

This invention relates to a meditation support, and more particularly to such a support having portions shaped to locate and maintain the user in position for meditation.

BACKGROUND OF THE INVENTION

Meditation is an increasingly popular technique for stress reduction and/or spiritual growth. Meditation is practiced in many positions, including sitting, walking, and reclining. The sitting position is favored by many practitioners, and particularly the lotus or cross-legged position. One such support for the lotus position is shown by Alfer in U.S. Pat. No. 4,673,216 issued Jun. 6, 1987. Another support known in the art is the traditional zafu which has the shape of a flattened sphere.

SUMMARY OF THE INVENTION

It is an object of this invention to provide a meditation support that provides comfort in a seated position over a meditation period of an hour or more.

In accordance with this invention a padded support cushion for use during periods of seated meditation for persons assuming a bent leg posture with their uncrossed legs resting before them on the floor one lying in front of the other. The generally triangular cushion of this invention somewhat resembles a fish's tail. The rear portion of the cushion is substantially thicker than the forward portion; the upper and lower surfaces being at an acute angle to one another. The wedge shape raises the user's buttocks several inches above the knees which contact floor level. This difference in elevation functions to shift the user's center of gravity forward so that the knees which are in solid contact with the floor bear some of the body's weight and to assist the user in maintaining a proper anterior curve of the lumbar spine which discourages slumping and attendant muscle fatigue. The user is thus able to sit for longer periods in comfort.

The most important feature of the invention is a precisely shaped indentation at the center of the front panel which conforms exactly to the shape of either heel when it is placed therein as required for proper use of this invention. This heel receptacle allows one foot and leg to be drawn up close to the torso's midline at the pubic bone. The other foot and leg are then placed immediately forward of the first leg without crossing it at any point. The user's buttocks and thighs now rest on the cushion supported evenly by continuous contact with the sloping surface of the cushion while the knees, legs and feet rest comfortably on the floor. In this posture the ankle bones make no or minimal contact with the floor avoiding any discomfort. The seated posture established by this invention minimizes the strain placed on the joints of the hips, knees, ankles and feet. The cushion tilts the user's pelvis forward slightly allowing the abdomen to expand more freely with the inhalation of air then would be the case were the support not wedge shaped.

The support offered the buttocks and thighs is of such evenness that the cushion may be felt to disappear. The skin surface pressure is decreased by such spreading of the weight over a larger area of contact between the user's body and the cushion minimizing discomfort due to loss of circulation in the superficial tissues.

This invention is a significant advance over the traditional Japanese zafu which has the shape of a flattened sphere. Two differences are apparent between this invention and the zafu. First, the present invention has a rounded indentation located at the center of the forward margin contoured to conform precisely to the shape of the user's heel so that either foot may be drawn up into immediate proximity to the midline of the torso at the pubic arch with the sole of this foot mating with the front vertical panel of the cushion lateral to this central heel receptable. The other unique distinction of this invention is that the upper surface is at an acute angle to the lower surface which rests on the floor level so, in effect, the user is seated on a wedge-shaped construct which serves to both raise the buttocks several inches above the knees which are in solid contact with the floor beneath the cushion, and shift the sitter's center of gravity forward.

The seat construction proposed by Alfer in the above-mentioned U.S. Pat. No. 4,673,216 is intended for a similar purpose, but it also differs from this invention in these same significant ways. Alfer is further distinguished from my invention in that it establishes the user in a position with hips and buttocks at the same approximate level as the knees and further is designed to accomodate the person in a seated posture that is known as the Lotus or Padmasana cross-legged. My invention is designed to establish the sitter in a posture with the legs bent at the knees, but not crossed at any point, and lying before the person on the floor one immediately in front of the other and drawn as close as possible to the torso and to each other.

The present invention intends that the user's knees make solid contact with the floor and in fact bear some weight at the points of contact in response to the forward shift in the user's center of gravity caused by the wedge shape of the cushion. The twin lateral extensions diverge as they taper toward their rounded points. They support the thighs from below and allow them to spread outward from each other to an angle approaching 90 degrees. When the user has assumed the required position it has been assumed the user's lower legs will contact the floor over an area lateral to the shin bone running from the tibial tuberosity and head of the fibula to the ankle crease occupied by the shin muscles of the forward compartment muscles and continuing across the ankle crease to include the dorsal aspect of the feet and toes. The ankle bones or lateral malleoluses making no or minimal contact with the floor thus preventing discomfort to the user. The support can be used on any level surface, but a carpeted one is preferred to a bare floor for comfort if the legs or feet are bare. The Japanese generally place the zafu on top of a square mat of a few inches thickness known as a zabuton which provides the legs and feet with a soft subsurface and insulation from cold.

The forward shift in center of gravity produced by the wedge shape of this invention causes the angle between the user's thighs and torso to increase when an erect posture of the spine is assumed. The user will experience that less effort is required to maintain the lumbar spine in slight extension as is optimal for proper seated posture and that muscular fatigue of the erector spinae muscles of the back and hip flexor muscles is reduced to allow the user to sit substantially longer periods of time without restlessness due to discomfort.

The continuous contact provided to the buttocks and thighs by this device equalizes the skin surface pressure, minimizing loss of circulation to the tissues and attendent discomfort when this is prolonged. The user is able to sit in comfort for periods ranging from 10 minutes to 90 minutes long. The intended posture for proper use of this invention is inherently simple and does not require unusual flexibility on the part of the user, although persons with lower than normal flexibility may need a period of several weeks to adjust to the intended posture or to be able to sit for more than a few minutes. This invention is aimed at minimizing the strain put on the joints of the lower limbs and affording stable resilient support to the user.

Another important way in which this present invention assists the user is by promoting the ease with which the person breathes in a seated position. It performs this function by virtue of its wedge shape which insures the user's ability to properly maintain the normal anterior curve of the lumbar spine while assisting the user in rotating the pelvis slightly forward so as to allow for free expension of the abdomen as the diaphragm presses downward on inhalation. The posture established by this cushion discourages the user from slumping forward, which restricts the flow of the breath and causes fatigue of the muscles of the upper back.

Features of the support of this invention for seated meditation include the following:

top and bottom surfaces of the support cushion are at an acute angle to each other on the order of 5 degrees to 15 degrees, preferably about 10 degrees, giving the support an overall wedge shape when seen in side elevation;

a pair of lateral extensions from the thicker central portion tapering gradually in vertical and horizontal dimensions to provide support for the user's thighs;

the cushion is constructed of a fabric cover of sewn construction stuffed with a resilient material, such a kapok fiber, cotton batting or flexible foam in such ample amount to provide firm stable comfortable support to the user;

the cushion can be constructed with an inner liner of muslin containing the stuffing, the whole of which is then encased in a slipcover fitted with a zipper allowing the user to remove the slipcover for laundering;

the invention could be constructed with a rigid hollow base of dense plastic or sheet metal shaped to accomodate several units to be stacked in nested fashion when not in use for space saving;

a carrying handle sewn into the seams at the center of the rear of the cushion permitting hand carrying of the support cushion, overall weight of the unit being between about 3½ pounds;

a rounded indentation at the center of the front of the cushion contoured to conform to the shape of either one of the user's heels permitting one of the feet to be drawn up snug to the midline of the torso at the pubic arch;

a slit at the rear of the cushion hidden from view by the carrying strap through which stuffing material can be added or substracted by the user as needed;

the cushion is in the order of 3½ to 7½ inches thick at its thickest portion with a thickness of 5½ inches preferred, it tapers to 1½ inches at the apexes of the pair of lateral extensions.

BRIEF DESCRIPTION OF THE DRAWINGS

FIG. 6 is a section of FIG. 1 taken along the line 6—6 indicated by the arrows in FIG. 1.

DESCRIPTION OF THE PREFERRED EMBODIMENTS

Figure 1:
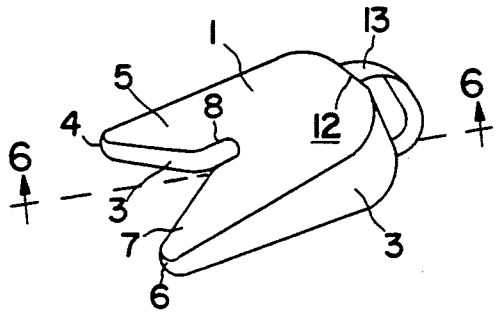
FIG. 1 is a perspective view of the meditation support cushion of this invention.

FIG. 1 shows in perspective view a padded support cushion having a fabric shell stuffed with resilient material to form a generally triangular three-dimensional object having a broad upper surface 1 and a lower surface 2 (FIG. 5) at an acute angle A (FIG. 5) to one another. The identical upper and lower pieces are sewn to an elongated panel 3 of variable width that wraps all the way around their circumferences, overlapping at the back midpoint 12 of the cushion beneath the carrying strap 13. The ends of the panel are sewn together, but overlap sufficiently to form an opening through which the stuffing can be put into or taken out of the fabric shell so as to attain the desired firmness.

FIG. 1 shows paired lateral extensions or bifurcations 5 and 7 diverging from the thicker central portion 28 (FIG. 4) and tapering to rounded points 4 and 6 at the extreme front of the construction. Also shown is an indented heel recess 8 in the midcentral section of the front of the cushion.

Figure 2:
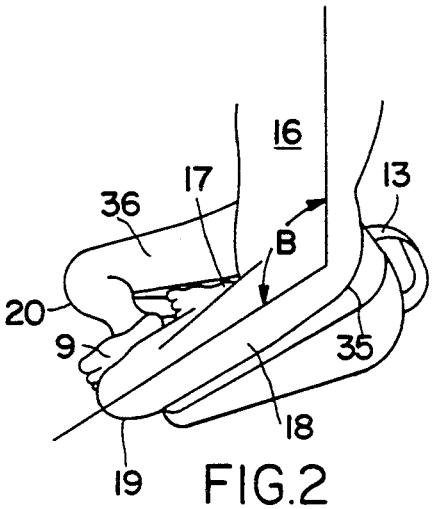
FIG. 2 is the perspective view of FIG. 1 showing a person sitting in the intended posture to illustrate the position of the lower limbs.

FIG. 2 is the perspective of FIG. 1 illustrating the intended position of a person seated on the cushion. The user does not sit squarely atop the rear of the cushion, but more in reference to the forward margin of the device, such that one heel 17, the user's left in this case, is fitted snugly into the central heel recess 8 allowing the limb to recline outward until the lateral side of the knee 19 makes solid contact with the floor level. The entire sole of this same foot contacts the front panel lateral to and right of the central heel recess.

Figure 4:
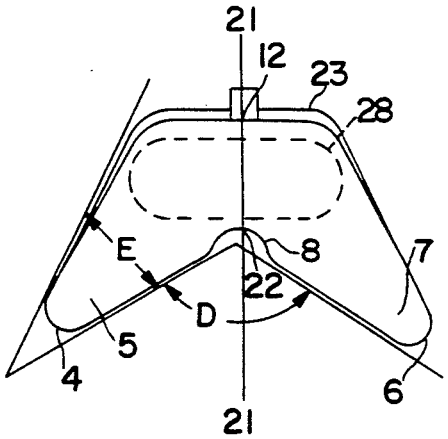
FIG. 4 is a diagram of the cushion of FIG. 3 in plan view illustrating the relative position of the buttocks, thighs, legs and feet of the user when seated in the intended position on the cushion.

Which of the heels is placed into the central recess is entirely the choice of the user as either will conform equally well, since the cushion is bilaterally symmetric about a median line 21—21 (FIG. 4). The user then places the opposite leg and foot, in this case the right, on the floor lying immediately forward of the first with the sole 9 of the right foot in contact with the shin of the left leg just below the tibial tuberosity. The outside of the right knee 20 is also in solid contact with the floor beneath the user.

The user's buttocks 35 are elevated several inches above the knees by virtue of the cushion being thicker at its central portion 28 (FIG. 4) than at the points 4 and 6 of the lateral bifurcated extensions which support the thighs 18 and 36 as they slope toward the floor. It is one of the features of this invention that the overall back to front slope affords continuous even support to the user's buttocks and to the thighs from their commencement at the hip joints to an area of each on the lateral aspect just above the crease at the back of the knees. This sloping configuration results in an increase of the angle B between the user's torso 16 and the thigh 18, in this illustration the left thigh, when an erect posture of the upper body is maintained. A slight forward rotation of the pelvis is encouraged as a result. The sitter's center of gravity is shifted forward by the elevation of the sitter's buttocks above the knees, so that significant weight is borne by the knees and legs in their contact with the floor. The sitter will experience that it is easier to maintain the proper degree of forward curvature in the lumbar spine with far less effort, and hence they are discouraged from slumping forward in the region of the upper back.

Focus on the breath and deepening of the breath in a natural unforced way are very common techniques accompanying many forms of meditation. One further advantage of the posture established in the user by the precise contours of the cushion is the increased ease with which the user can breath, since the space between the ribcage and pubic bone is lenghtened to permit the abdomen to expand out and down more freely in response to pressure from the diaphragm on inhalation.

The cushion further functions to place the user's legs in a comfortable position on the floor such that they are in contact with it over an area roughly that occuppied by the shin muscles of the leg lateral to the shin bone ridge and continuing across the ankle crease to include the dorsums of the feet and toes of both lower limbs, the feet being in plantar flexion with the toes pointed. It is especially noteworthy that the intended posture for proper use of the support positions the ankle bones on the lateral aspects of the lower legs out of contact or in minimal contact with the floor, thus avoiding a potential source of discomfort due to excess pressure being placed on the tissue covering these boney prominences. For optimal comfort is is suggested that the floor beneath the cushion be covered with a pile carpet or as is customary a soft pad sometimes called a zabuton, after the Japanese pads for this purpose, be placed underneath the cushion and lower legs to add to the user's comfort.

Figure 3:
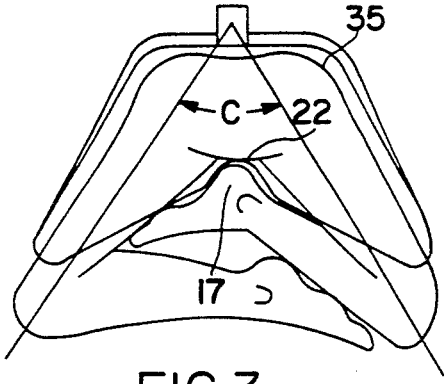
FIG. 3 is a plan view of an embodiment of the cushion of this invention.

FIG. 3 shows a plan view of the cushion illustrating the position of the sitter's buttocks, thighs, legs and feet with respect to the cushion. Noted the left heel 17 placed in the central heel receptable so as to be positioned in close proximity to the ventral midline of the body close to the pubic bone at the base of the sitter's torso and on line 21—21 (FIG. 4) passing through the center point 22 of the heel recess. The horizontal angle separating the user's thighs C in the intended posture is considerably above 45 degrees and approaches 90 degrees.

The intended posture for use of this cushion in seated meditation does not demand unusual flexibility on the part of the user. The slope of the user's lower body relative to the floor in conjunction with the spreading of the thighs results in a minimum of strain being placed on the joints of the lower limbs. For those with less flexibility a period of adaptation may be necessary before the intended posture can be assumed with ease.

FIG. 4 is a plan view of the preferred embodiment of the support of this invention, showing it is bilaterally symmetric about line 21—21. The distance between points 12 and 22 on line 21—21 is approximately 8 inches. The length from the rear margin 23 to a line joining the points 4 and 6 of the lateral extensions at the front of the cushion and measured along line 21—21 is approximately 15 inches. The total width from the extreme lateral margin of one of the lateral extensions near its point 4 to a similar point 6 on the outer margin of the other lateral extension is approximately 23 inches. Both length and width are able to be increased or decreased to accomodate persons of larger and smaller size. The angle of divergence D of the tapering lateral extensions is between 125 degrees and 150 degrees, 135 degrees being preferable. The angular measurement of the lateral extension themselves, angle E of this Figure, is approximately 55 degrees. The width of the extensions at their widest point near the central recess measured perpendicular to a line connecting the rear midpoint 12 with the apex 4 or 6 of either is approximately 9½ inches. This width could be increased or decreased in response to changes in overall size of the cushion or changes in angles D and E. The central area 28 of the thick central portion is shown by the dashed line as being where the user's buttocks would rest in the intended posture.

Figure 5:
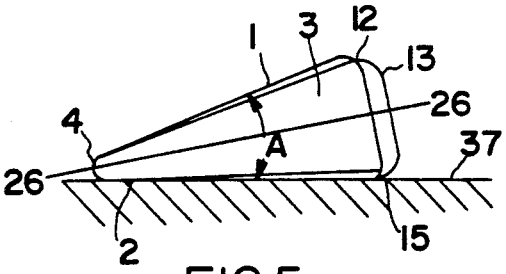

FIG. 5 is a side elevation showing the angle of slope A of the upper surface of the cushion relative to the level surface 37 beneath it. This angle being on the order of 5 degrees to 15 degrees, with approximately 10 degrees being preferable. The height of the cushion at its rear midpoint 12 measured perpendicular to floor level 37 is approximately 5½ inches, but could be varied from 7½ inches to 3½ inches and still function properly. The height at the narrow end of the lateral extension at the front margin near the apex 4 is approximately 1½ inches and could be varied from ½ to 3 inches as needed.

FIG. 5 further shows the carrying strap 13 which is sewn into the seams of the cover at the middle of the rear of the cushion and traverses the distance between the upper midpoint 23 and the lower midpoint 15, with enough extra length to admit the fingers of one hand to slide beneath it for grasping while the cushion is hand carried from place to place by the user. The cushion is symmetric about line 26—26 of this Figure.

Figure 6:
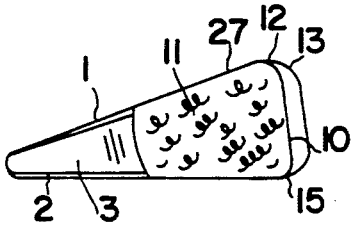
FIG. 6 is a side elevation showing the wedge shape of the cushion and its symmetry about line 26—26.

FIG. 6 is a section taken along a line through the medial vertical plane of the cushion shown in FIG. 1. The view is of the right half of the cushion as indicated by the arrows. The fabric cover 27 is dissected to reveal the resilient material 11 it contains.

Materials such as kapok fiber, cotton batting, polyester fiber, shredded foam, or buckwheat or rice hulls are all suited to the purpose. Such materials could first be placed within a muslin casing identical in every way, except lacking a carrying strap, and the whole then placed within a slipcover having an opening of sufficient size perhaps along the rear inferior seam fitted with a means of closure such as a zipper, for example. The slip cover could therefore be removed and replaced by the user for the purpose of laundering same as needed. Such an arrangement would also permit the inner resilient material to be comprised of flexible foam molded to the desired shape to be placed into the fabric slipcover in the same way as the stuffed mulsin casing mentioned above. Any loose fibrous or granular materials can be placed into the fabric shell through a vertical opening 10 at the middle of the back of the cushion, of the length of the distance between the upper seam midpoint 12 and the lower seam midpoint 15. This opening is hidden from view by the carrying strap (which is approximately 1¼ inches in width). The ends of the fabric panel 3 comprising the opening overlap each other, providing a means to prevent the stuffing materials from escaping from the cushion after emplacement.

Figure 7:
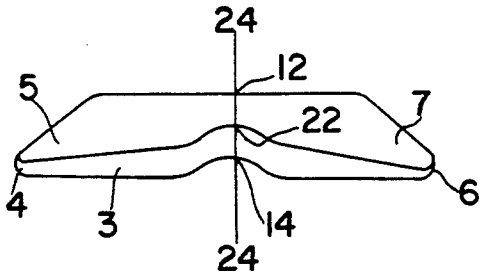
FIG. 7 is a front elevation showing the symmetry of the cushion about line 24—24 illustrating the height of the central heel indentation as being greater than the height of the outer ends of the front panel of the cushion and less than the height of the thicker rear portion.

FIG. 7 is a front elevation showing the support as bilaterally symmetric about line 24—24 of the Figure. This view makes evident the changes in height of the front panel 3 of the cushion. It measures approximately 1½ inches in height at each end near the points 4 and 6 of the lateral extensions 5 and 7, and increase in height gradually to a maximum at the central heel recess. The vertical height measured from point 22 to point 14 along line 24—24 is 3½ inches. The vertical height from point 22 to point 12 at the midpoint of the rear portion of the cushion measured along line 24—24 is approximately 2 inches in this preferred embodiment.

Figure 8:
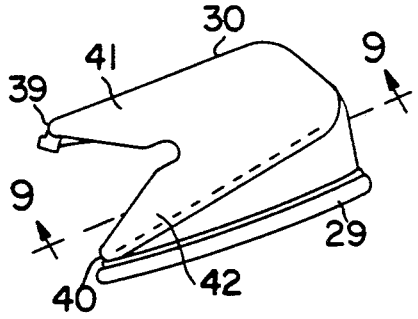
FIG. 8 is a perspective view of a hollow stackable embodiment of the cushion of this invention.

FIG. 8 is a perspective view of a stackable version of this invention formed in a configuration and of such rigid materials as to permit it to be placed in a vertical stack of several identical units of this type for storing when not in use. This version is comprised of a rigid base 29 which in plan view is essentially u-shaped and made of dense plastic or sheet metal of suitable strength and having a layer of resilient padding 31 of approximately 1 to 1½ inches in thickness attached to its upper surface to afford stable comfortable seating to the user. This layer being itself covered by a layer of durable fabric 38. In addition to being open on the bottom surface, this stackable construction is also lacking a front vertical panel along its front margin between the pointed terminations 39 and 40 of the pair of lateral extensions 41 and 42 of this version of the support. The presence of a front panel not being necessary for stacking of the device, but such presence may prevent the user's heel being drawn up sufficiently close to their torso as is optimally desired.

Figure 9:
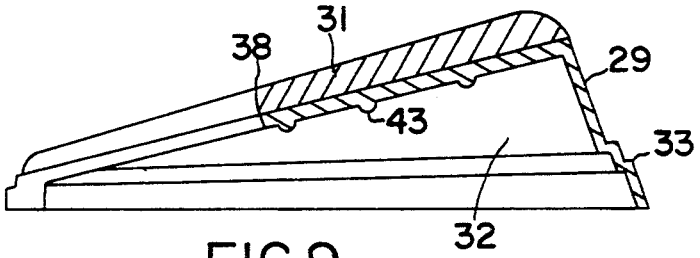
FIG. 9 is a sectional view in the direction of the arrows of FIG. 8 to show the hallow cavity formed by the rigid base of the support.

FIG. 9 is a sectional view of the invention shown in FIG. 8 to illustrate the hollow space 43 beneath the upper surface of the rigid base. Several details are worth noting: first, the layer of resilient padding 31 affixed to the upper surface of the base 29; secondly, a series of ridges on the underside of the base to act as reinforcing to insure sufficient load bearing strength to the construction; and thirdly, a stepped configuration 33 of the lower perimeter of the rigid base to serve in guiding the units into proper alignment with those units placed above and below it in the vertical piles of several identical units. This stepped configuration also permits adequate space 44 of FIG. 10 to remain between consecutive units in the stack to insure the padding of the supports is not compressed by the support placed above it.

Figure 10:
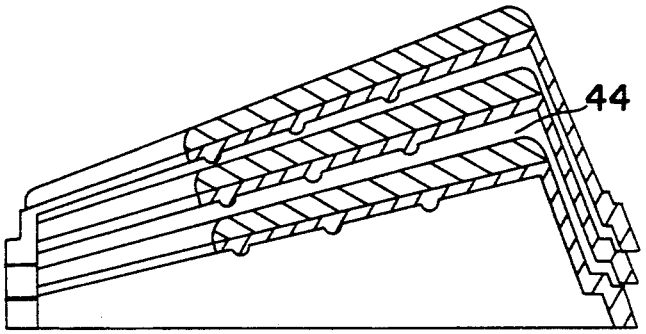
FIG. 10 is a sectional view taken about the medial line of symmetry of FIG. 8 illustrating a stack of three identical supports piled one on top of the other for compact storage.

FIG. 10 is a sectional view taken along the same median line as FIG. 9 showing three of the stackable versions placed in one on top of the other in a vertical pile for storage for space saving through reduction of the total volume occupied by the pile.

Figure 11:
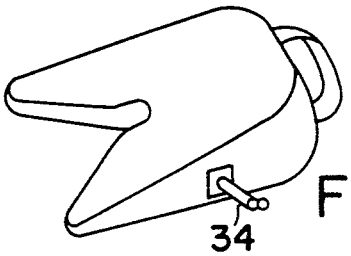
FIG. 11 is a perspective view of an inflatable embodiment of the cushion of this invention showing a filling valve.

FIG. 11 is an inflatable version of the support cushion of this invention. A valve stem 34 has been placed in the side panel to permit the device to be inflated and deflated as needed by the user. This version could be inflated with air from the user's lungs just prior to use and removed after use so the device would occupy only minimal volume. The inflatable version could be constructed of rubber or pvc plastic and its surfaces embossed to reduce any tendency to slide out from under the user. This version could consist of an inner inflatable bladder, with a zippered slipcover stretched over it, with an opening in the slipcover to permit the filling valve stem to protrude through it for inflation and deflation by the user.

What is claimed is:

1. A meditation support adapted to be positioned on a floor-like surface to support a sitting user, said support comprising a cushion having a high end sloping to a low end, said high end providing a buttocks support portion, said low end being bifurcated to provide thigh support portions, a recess being located within the opening between the bifurcated thigh portions, said recess being shaped to provide a heel anchoring portion, such that a user of said support being seated on said cushion between said high end and said recess is aided in maintaining both knees on the floor-like surface beyond said bifurcated thigh portions.

2. The meditation support of claim 1 wherein said cushion has a constant slope from said high end to the outer reaches of said bifurcated thigh portions.

3. The meditation support of claim 1 wherein said recess is located in one of said bifurcated thigh portions, and a second recess is located in the other of said bifurcated thigh portions.

4. The meditation support of claim 1 wherein said high end of said cushion is of such height as to incline the user toward said bifurcated portions.

5. The meditation support of claim 1 wherein said cushion has means to vary the degree of support offered to the user.

* * * * *